US005348106A

United States Patent [19]

Mattero

[11] Patent Number: 5,348,106

[45] Date of Patent: Sep. 20, 1994

[54] METHOD OF DRILLING A HOLE IN A ROCK

[75] Inventor: Unto Mattero, Helsinki, Finland

[73] Assignee: Tamrock Oy, Tampere, Finland

[21] Appl. No.: 81,316

[22] PCT Filed: Jan. 2, 1992

[86] PCT No.: PCT/FI92/00002

§ 371 Date: Jun. 22, 1993

§ 102(e) Date: Jun. 22, 1993

[87] PCT Pub. No.: WO92/12329

PCT Pub. Date: Jul. 23, 1992

[30] Foreign Application Priority Data

Jan. 3, 1991 [FI] Finland ..... 910039

[51] Int. Cl.[5] ..... E21B 44/00

[52] U.S. Cl. ..... 175/27; 173/1; 173/4; 175/24

[58] Field of Search ..... 175/27, 24; 173/4, 11, 173/1

[56] References Cited

U.S. PATENT DOCUMENTS

| | | | |
|---|---|---|---|
| 3,581,830 | 6/1971 | Stoner | 173/6 |
| 3,613,805 | 10/1971 | Lindstad et al. | 175/27 |
| 3,669,197 | 6/1972 | Hanson et al. | 173/19 |
| 3,823,784 | 7/1974 | Feucht | 173/1 |
| 4,074,771 | 2/1978 | Morrison | 173/11 |
| 4,165,789 | 8/1979 | Rogers | 175/27 |
| 4,354,233 | 10/1982 | Zhukovsky et al. | 364/420 |
| 4,793,421 | 12/1988 | Jasinski | 175/27 |
| 5,121,802 | 6/1992 | Rajala et al. | 173/1 |
| 5,131,475 | 7/1992 | Beney | 175/27 X |

FOREIGN PATENT DOCUMENTS

| | | |
|---|---|---|
| 751749 | 6/1979 | Finland . |
| 770950 | 5/1984 | Finland . |
| 81866 | 5/1985 | Finland . |
| 0145701 | 4/1988 | Sweden . |

*Primary Examiner*—Hoang C. Dang
*Attorney, Agent, or Firm*—Nixon & Vanderhye

[57] ABSTRACT

A method of controlling a rock drilling process by adjusting the percussion power and the feed force of a drilling machine. In the method, the drilling is carried out automatically in stages so that the percussion power and the feed force as well as drilling time or drilling depth are adjusted at a start-up drilling stage, and the ratio between the percussion power and the feed force is adjusted at a transition stage while increasing them until the set value of normal drilling is achieved. In normal drilling, the feed force is adjusted so that the rotation power remains at the set value.

4 Claims, 3 Drawing Sheets

POWER SETTING
21
22
a0
k0
RAMP ANGLE
20
ACTUAL VALUE OF POWER SETTING
32
31
a1
k1
30
ADJUSTMENT OF PERCUSSION POWER Pp
P
42
41
a2
k2
40
SETTING MINIMUM FEED
fmin
Max(a, b)
50
fc
ADJUSTMENT OF FEED
Cmin
71
77
Cmin
Cmax
Cmin
Cmax
Cmin
fs
ADJUSTING VALUE FOR FEED
ADJUSTER
70
60
63
62
61
SETTING ROTATION PRESSURE FOR BIT/ROCK CONTACT
ACTUAL VALUE OF ROTATION PRESSURE FIG. 3
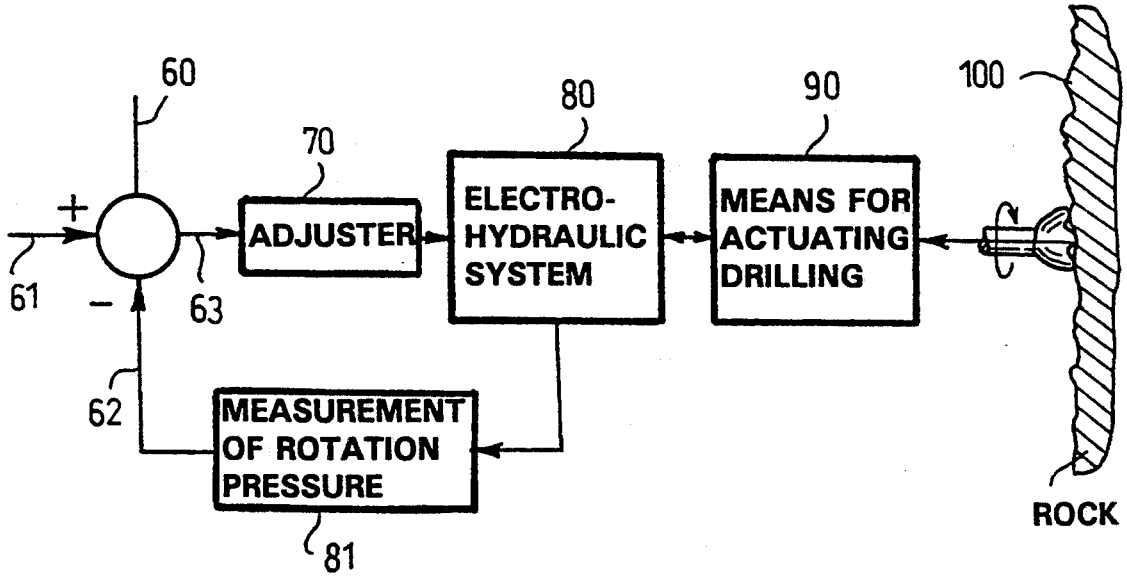
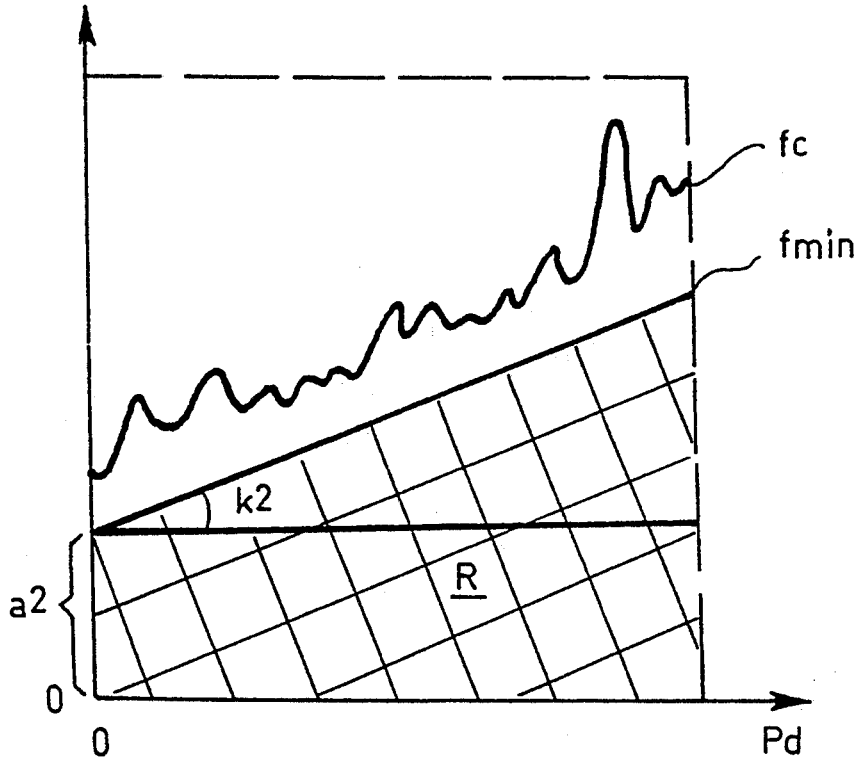
FIG. 4

METHOD OF DRILLING A HOLE IN A ROCK

This invention relates to a method of controlling a rock drilling process, wherein a percussion power and a feed force of a drilling machine are adjusted to optimize the drilling process so that the rotation power of the drill is no more than a preset limit value.

Rock drilling is usually based on a control system in which the driller controls the operation of the equipment on the basis of his practical experience. In such cases, the driller usually sets certain basic values on the basis of the assumed conditions and does not have time to observe possible deviations and to control the operation accordingly. Especially with a drilling equipment comprising several booms, the driller is not able to observe all of them sufficiently efficiently and continuously to be able to control them optimally. This usually results in partially inefficient drilling as well as equipment damages.

In systems based on automatic control of drilling, the feedback and control are effected by using hydraulic actuating means in such a way that one operating parameter, such as percussion, rotation or feed, is controlled on the basis of another parameter so that, for instance, The feed is retarded or the percussion is increased when the force required for rotation increases. In these solutions, the adjustment is based on mere proportioning of certain operating parameters to each other without being able to more accurately set adjusting parameters dependent on the conditions.

U.S. Pat. No. 4,793,421 discloses a programmed automatic control system aimed at optimizing the drilling. This system utilizes two groups of parameters one of which is used to control the maximum rotation rate by sensing means and the other to control the supply of the maximum power to the feed motor. In the US Patent, the maximum values of both rotation and feed are applied until the preset limit values are achieved in either way or the drilling conditions require that the limit values be reset. The system of the US Patent is not directly applicable to rock drilling as it adjusts only rotatory drilling. In addition, the system merely aims at maximizing the rotation power or feed power, while the different drilling stages are not adjusted separately.

U.S. Pat. No. 4,354,233 discloses a solution iin which a computer compares a preset penetration value to an actual penetration value. In this method, the rotation rate and the axial load, i.e. feed, as well as torque and oscillation rate are adjusted. Changes in the adjusting values of the different drilling stages are not taken into account in any way.

U.S. Pat. No. 4,165,789 discloses a method in which the optimization is based on the adjustment of the rotation of the drilling machine and the adjustment of the rotation resistance. The method aims at keeping one parameter constant by adjusting the other parameter. The solution is very simple and does not enable the optimization of the entire drilling process. Moreover, it does not in any way take into account the different adjustments and parameter changes required at the different drilling stages.

U.S. Pat. No. 3,581,830 teaches measuring torque of the drill rod, the feed force being used as an adjusting parameter. The feed force, that is, the feed rate is decreased when the adjustment exceeds a preset value. This U.S. patent merely aims at keeping the torque strain of the drill rod below a certain limit value and it does not in any way teach adjusting or not even aim at adjusting the drilling process by changing the set values as required by the different drilling stages. A common disadvantage of the systems of the above-mentioned patent documents is that they adjust only a part of the drilling process and their parameters are difficult if not impossible to change.

A further disadvantage of the prior art systems is that they typically result in uneconomic drilling as the drilling parameters are inappropriate in one way or another. Systems based on hydraulic control respond rather slowly to sudden changes occurring during the drilling, as a result of which inefficient and uneconomic drilling as well as equipment damages occur very frequently. Furthermore, the fine adjustment and modification of systems based solely on hydraulics is difficult and, in practice, it is impossible to make them monitor the drilling conditions accurately and thus economically and technically efficiently.

The object of the present invention is to provide a method for effecting drilling in such a way that the disadvantages of the known solutions are avoided and the drilling process is efficient and always takes into account the drilling conditions. The method according to the invention is characterized in that the drilling is controlled automatically in stages by effecting the drilling stages sequentially one at a time, and that the adjusting parameters affecting the percussion power and the feed force are set at each drilling stage so that the percussion power and the feed force are optimal for the drilling stage in question.

The basic idea of the invention is that the drilling is controlled at its different stages by parameters required by each particular drilling stage in such a way that each drilling stage is carried out as well and as efficiently as possible. An advantage of the invention is that the drilling is as economic as possible while any unnecessary strains on the drilling equipment are avoided and thus a considerable reduction in equipment damages is achieved as compared with the prior art techniques.

The invention will be described in greater detail in the attached drawings, in which FIG. 1 shows schematically the principle of adjustment of the method according to the invention;

FIG. 3 shows schematically the principle of adjustment of the contact between drill bit and rock: and FIG. 4 shows schematically the operating range of the adjuster of FIG. 3.

Figure 1:
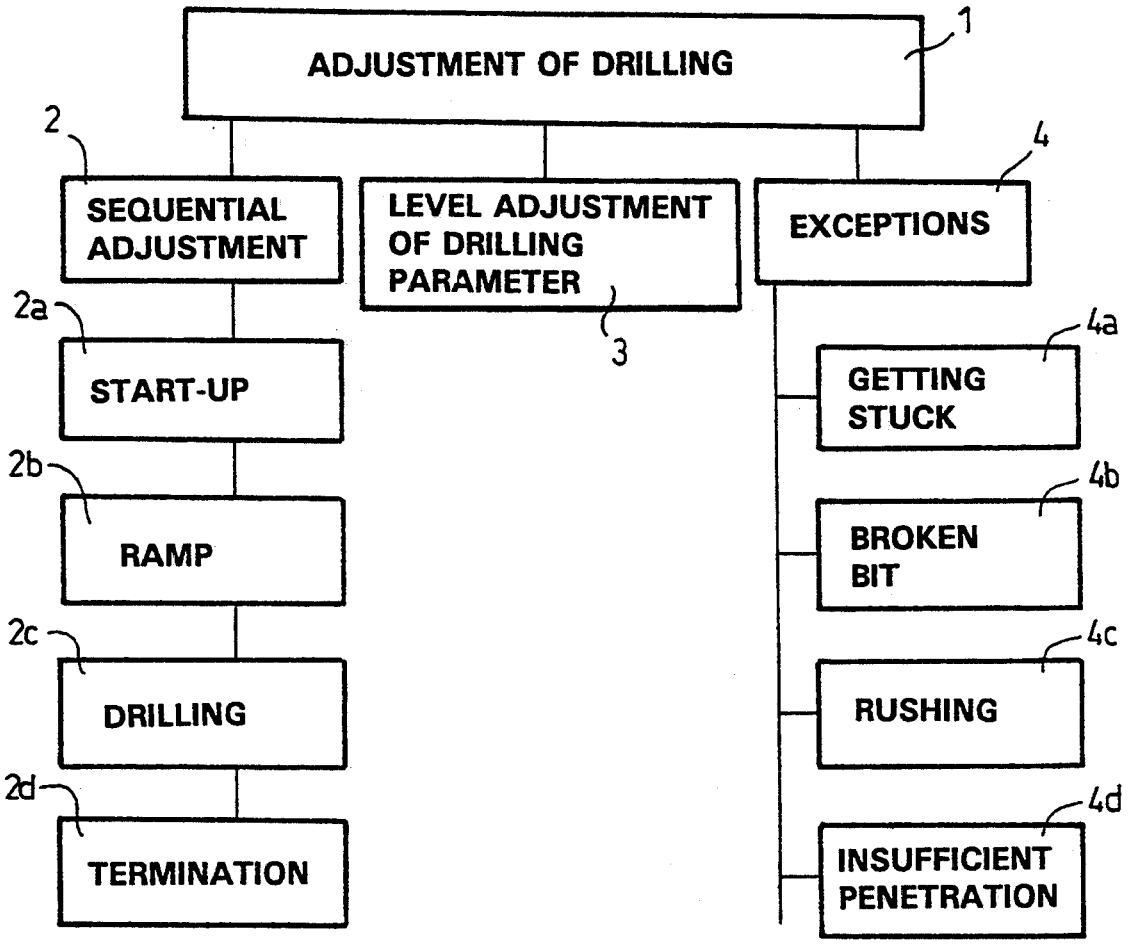

FIG. 1 shows schematically an adjusting diagram of the method according to the invention. An adjustment 1 comprises various operational alternatives based on the prevailing conditions and situation. Its primary parts are sequential drilling adjustment 2, level adjustment 3 of drilling parameters, and handling 4 of exceptional situations. Normal sequential drilling comprises four stages: start-up drilling 2*a*, a ramp stage 2*b* through which the transition from start-up drilling to normal drilling 2*c* takes place, and finally termination 2*d* of drilling. In addition, there is, in principle, a fifth stage, that is, a stop state, in which the equipment is ready to start the drilling. Handling of exceptional situations comprises various possible exceptional situations, such as getting stuck 4*a*, broken drill bit 4*b*, rushing 4*c*, and insufficient penetration 4*d*, and their handling.

In the start-up drilling *2a*, the percussion power and the feed rate level as well as the time or drilling depth during which the start-up parameters are applied are preset. Thereafter the transition from start-up drilling to normal drilling takes place through the ramp, whereby the control of the percussion and feed is increased towards the set power level through the rising ramp in such a way that the rise is substantially linear. At this transition or ramp stage *2b*, the parameter to be preset is the ratio between the percussion and the feed, that is, the ratio between the percussion power and the feed force. After the ramp *2b*, the normal drilling *2c* is in progress, and the adjustment of the contact between bit and rock is added to the operation, and the level of feed is adjusted so that the rotation pressure of the rotation motor of the drill rod remains at a preset value. The normal drilling further comprises an adjuster provided with a limiter. The adjuster ensures that the feed is sufficient with respect to the set level of drilling power even when the rotation pressure is exceptionally high for one reason or another, e.g. when drilling obliquely for some reason or when the pressure oil is still cold at the onset of the drilling process. When the rotation pressure has increased sufficiently, the adjuster becomes passive, and a so-called fissure automation adjustment is introduced for normal adjustment of the drilling process. The fissure automation adjustment is known per se and can be realized in various ways, wherefore it is not described in greater detail herein. After The completion of the hole, the return stage *2d* follows, during which the drill is usually retracted by a rapid movement, and when the drill bit is at a predetermined distance from its fully retracted position, the movement of the drill is retarded until it stops when the drill reaches its fully retracted position.

In the control of the drilling process, the above-mentioned fissure situation, flushing and penetration, among other things, are monitored.

Fissure automation operates in response to the rotation pressure, which is monitored, and when the rotation pressure exceeds a preset upper limit, the drill is retracted immediately by a rapid movement, and the drilling is then continued at reduced power a predetermined distance after the rotation pressure has decreased below a predetermined lower limit. Transition back to the preset level of drilling power through the ramp stage *2b* does not take place until after this predetermined drilling at reduced power.

Flushing is supervised by monitoring the flow of flushing water at the flow rate. If the flushing is interrupted for some reason and is out of operation for a predetermined period of time, the drill is retracted e.g. by simultaneous percussion until the flushing is again operative or until the drill reaches its retracted position. If the flushing starts to operate before the drill is in its retracted position, the drilling is again continued at reduced power a predetermined distance, whereafter the transition from the reduced power To the set power level through the ramp stage *2b* takes place.

Penetration is supervised by setting a lower limit value for the penetration rate, which prevents the drilling operation if the drill does not penetrate into the rock sufficiently rapidly during the drilling. This may happen e.g. when the drill bit is broken or some other part of the equipment is damaged. In this case, the parameter to be set is time. If the penetration rate during this preset time is lower than the preset penetration limit value, the supervision operation is started and thus the drilling operations are stopped. Correspondingly, the upper limit of the penetration rate is monitored so as to be able to prevent the drilling when the penetration rate is too high, that is, the drilling equipment rushes onwards. The monitoring of such rushing prevents the percussion operation when the bit is out of contact with the rock, thus preventing damage to the equipment, in this case, the parameter to be set is the time by which the penetration rate has to exceed the preset limit value to activate the supervision operation.

Figure 2:
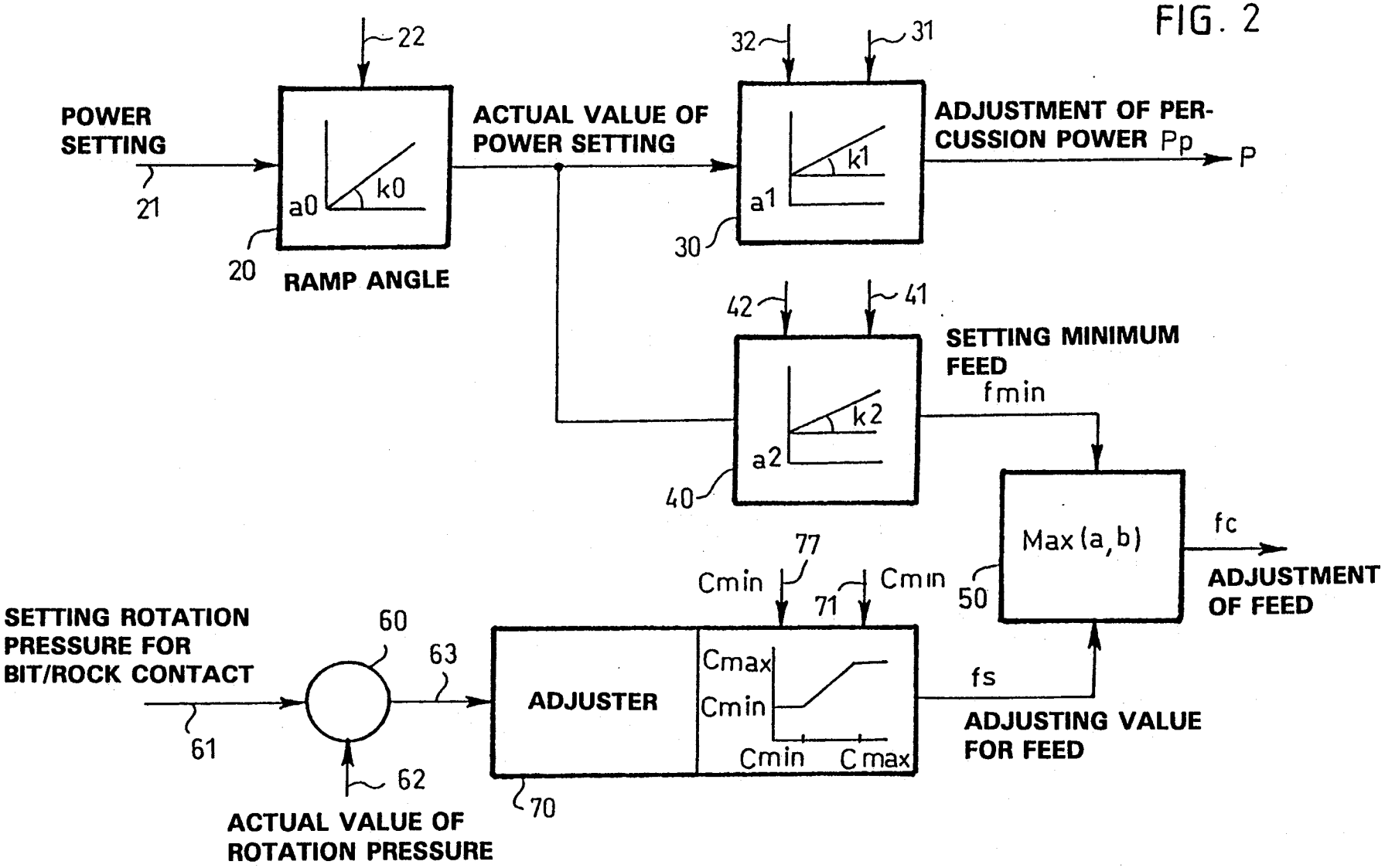
FIG. 2 shows schematically the ratio between the drilling power and the feed force when applying the method according to the invention.

FIG. 2 shows schematically a block diagram for the adjustment of drilling. In the block diagram, the reference numeral 20 indicates the adjustment of the drilling power, in which a set value 21 for the drilling power is set between 0 and 100%, and then a slope 22 is set by which the rising angle k0 of the drilling power is adjusted, i.e. the velocity at which the value of the drilling power increases at the ramp stage. The present actual value of the drilling power is further applied to percussion power adjustment 30 in which an initial value 31 for the percussion power, that is, the minimum value a1 of the percussion power, and correspondingly a slope 32 for the percussion power for adjusting its rising angle k1 are set. Adjusting means controlled by this adjustment block are affected by an adjusting value $P_p$ of the percussion power. Correspondingly, the present actual value of the drilling power affects an adjustment block 40, which sets a minimum feed force for feed adjustment. Similarly as in the adjustment block 30, a minimum value 41 is set by which a minimum value a2 for the feed force is adjusted, and correspondingly 42, by which the rise angle k2 of the feed force is adjusted. From these values, a set value $F_m$ is obtained, which indicates the minimum value of the feed force. This is applied to an adjuster 50 for the feed force. Correspondingly, a set value 61 for the rotation pressure and an actual value 62 for the rotation pressure are applied to an adjustment difference indicator 60 so as to adjust the feed motor, the feed being adjusted in an adjustment block 70 on the basis of a difference 63 between these values. The adjustment block 70 sets the upper and lower operating values for the pressure to keep the rotation pressure within a range appropriate for the operation, which prevents the so-called saturation of the control of the feed in view of the operation. Within the defined range, the feed is adjusted by applying the obtained set feed value $f_s$ to a comparator 50, which selects the greater out of the values $f_{min}$ and $f_s$ and then adjusts a feed level $f_c$ by means of it. In the case of FIG. 2, the value of the drilling power also has a forward influence on the value of the feed, that is, the connection is of the feedforward type, in which the value of the feed changes in the same direction as the value of the drilling power, that is, the feedforward takes place from the power adjustment block 21 through the block 20 to the block 40 and further to the block 50 up to the adjusted feed value $f_c$. Correspondingly, the measurement of the rotation pressure and the control effected by means of it establish a feedback loop, in which the feedback consists of the difference signal 63 generated by the difference between the set value 61 and the actual measured value 62 of the rotation pressure. This signal adjusts the feed value $f_c$ through the adjuster 70 in a reverse direction with respect to itself.

FIG. 3 shows schematically the principle of adjustment of the contact between bit and rock. The comparator 60 applies the difference 63 between the set value 61 and the actual measured value 62 of the rotation pressure to control the adjuster 70 for controlling the feed. The adjusted feed value is applied to an electro-hydraulic system 80 from which the rotation pressure is measured by a measuring device 81 and applied as the signal 62 to the difference indicator 60. The electro-hydraulic system 80, in turn, utilizes actuating means 90 for drilling a hole in a rock 100. In this figure, the adjustment of the percussion power and the drilling power as well as the adjustment of the minimum feed force have been omitted for the purpose of facilitating the understanding of the operating principle. In the arrangement shown in FIG. 3, the operation is based on giving the rotation pressure a certain set value and the pressure is attempted to be kept at this value by measuring the actual rotation pressure and by adjusting the feed by means of the pressure differences. The drill bit (not shown) is thereby pressed against the surface to be drilled with a substantially constant force, and it operates as efficiently as possible from the viewpoint of drilling technology. In this way, the frictions of the feeding mechanism and other factors affecting it and impairing the drilling result can be compensated for. If the feed is too weak, the drill tends to loose contact with the rock, as a result of which the rotation pressure drops and the pressure difference 63 increases. Consequently, the feed is increased until the pressure difference is substantially 0. Correspondingly, if the value of the feed is too high, the rotation pressure increases and the pressure difference indicated by the comparator 60 is negative, thus retarding the feed until the pressure is substantially at its set value.

FIG. 4 shows schematically the operating range of the adjuster shown in FIG. 3. In the figure, the horizontal axis Pd represents the set drilling power, and the minimum feed force a2 and the slope k2 rising in response to the drilling power are also presented in it. Below the line $f_{min}$ defined by these, the prohibited area of the feed control is indicated by a cross-ruled area R, that is, the feed force always has to be above the line $f_{min}$ or at least equal to it. The curve $f_c$ represents a specific adjustment curve which shows the adjustment of the feed force as a function of the drilling power and other conditions.

The invention has been described above and shown in the drawings schematically by way of example, and it is in no way restricted to this example.

I claim:

1. A method of controlling a rock drilling process, wherein a drilling machine has percussion power ($P_p$) and feed force ($f_c$) adjustable to optimize the drilling process so that the rotation power of the drill is no more than a preset limit value, comprising the steps of:

controlling the drilling automatically in sequential stages;

establishing at least three successive drilling stages including a first drilling stage for start-up drilling, a second stage comprising a transition stage from start-up drilling to a normal hole drilling stage, and a third stage comprising the normal hole drilling wherein appropriate values are set for drilling at each drilling stage to carry out the drilling;

setting parameters affecting the percussion power ($P_p$) and the feed force ($f_c$) at each drilling stage so that the percussion power ($P_p$) and the feed force ($f_c$) are optimal for each drilling stage.

2. A method according to claim 1, including the steps of using the feed force ($f_c$) and preset drilling time or preset drilling depth as parameters at the start-up drilling stage, setting the percussion power ($P_p$) and the feed force for starting the drilling and starting drilling by drilling the hole for the preset time or over the preset drilling depth.

3. A method according to claim 2 including the steps of increasing the percussion power and the feed force in a substantially evenly rising manner during the transition stage until the set values of the normal drilling are achieved, and, setting, during the transition stage, the ratio between percussion power ($P_p$) and feed force ($f_c$).

4. A method according to claim 3 including the step of adjusting the feed force ($f_c$) at the drilling stage so that rotation power remains substantially equal to a preset value.

* * * * *